US006454856B1

(12) United States Patent
Jung

(10) Patent No.: US 6,454,856 B1
(45) Date of Patent: Sep. 24, 2002

(54) STRUCTURE OF WINDING CORRECTION TAPE IN CORRECTION TAPE ADHESIVE

(76) Inventor: Gye Ho Jung, 588-8 Sibjeong 2-dong, Bupyeong-gu, Incheon City (KR)

( * ) Notice: Subject to any disclaimer, the term of this patent is extended or adjusted under 35 U.S.C. 154(b) by 0 days.

(21) Appl. No.: 09/617,452

(22) Filed: Jul. 17, 2000

(51) Int. Cl.[7] ..... B05C 1/06

(52) U.S. Cl. ..... 118/76; 118/200; 118/257; 156/577; 156/579; 400/695; 400/696; 400/700

(58) Field of Search ..... 118/76, 200, 257; 156/577, 579; 400/695, 696, 700

(56) References Cited

U.S. PATENT DOCUMENTS 5,430,904 A 7/1995 Ono et al. ..... 15/104
5,472,560 A 12/1995 Horng ..... 156/577
5,512,128 A 4/1996 Manusch et al. ..... 156/577
5,792,263 A * 8/1998 Koyama et al. ..... 118/257
5,942,036 A 8/1999 You ..... 118/257
6,206,072 B1 * 3/2001 Orihara et al. ..... 156/577

* cited by examiner

*Primary Examiner*—Laura Edwards

(57) ABSTRACT

A device for winding correction tape in a corrective film dispenser comprising a supplying reel and winding reel arranged between upper and lower cases and a tape guider projected through the front ends of the cases through which a correction tape with a coating of correction film applied thereon is fed from the supplying reel to the winding reel and wherein said winding reel with a gear is arranged in the front of the cases and the supplying reel is arranged in the rear of the cases, and wherein a first auxiliary reel with a gear is arranged between the winding reel and the supplying reel and is engaged rotatively with the gear of the winding reel, and a second auxiliary reel is arranged between the supplying reel and the first auxiliary reel, said correction tape being fed from the supplying reel to the winding reel via circumferential surface of the auxiliary reels.

1 Claim, 2 Drawing Sheets

STRUCTURE OF WINDING CORRECTION TAPE IN CORRECTION TAPE ADHESIVE

BACKGROUND OF THE INVENTION

1. Field of the Invention

The present invention relates to a structure of winding a correction tape in a correction tape adhesiver, and more particularly to a structure of winding a correction tape in a correction tape adhesiver for pressing the correction tape against the position in which clerical error has been occurred to transfer white coating film attached on the correction tape onto the position in which clerical error has been occurred, wherein auxiliary reels are provided between a supplying reel and a winding reel, the correction tape being fed from the supplying reel to the winding reel via the auxiliary reels so as to maintain constant tension between the correction tape and the reels, thereby the correction tape adhesiver being used smoothly, and the trouble of the correction tape adhesiver being prevented.

2. Description of the Prior Art

A correction tape adhesiver of the prior art comprises a supplying reel and a winding reel, the supplying and winding reels being arranged in a case. A correction tape rolled on the supplying reel, which includes a coating film applied thereon, is fed from the supplying reel to the winding reel via a tape guider which is projected through the front ends of the case. When the guider, through which the correction tape 5 is passed, is pressed against the position in which clerical error has been occurred and then moved, the white coating film applied on the surface of the correction tape is transferred onto the position in which clerical error has been occurred, so that the position in which clerical error has been occurred can be screened.

The winding reel is provided with a gear, and the supplying reel is provided with a gear engaged rotatively with the gear of the winding reel in order to apply appropriate tension to the correction tape which is wound onto the winding reel from the supplying reel via the guider.

The correction tape is unrolled from the supplying reel and then wound onto the winding reel only when the correction tape is pressed against the surface of a paper by virtue of appropriate force from the user and moved under the pressed condition. To this end, a plurality of grooves is formed on a rotating shaft so that appropriate surface contact is maintained between the inserting hole by which the supplying reel is engaged rotatively with the gear and the rotating shaft, whereby sliding of the supplying reel and the rotating shaft of the gear is possible when force of more than the predetermined amount is applied to the supplying reel and the rotating shaft of the gear. Alternatively, a compression spring is provided between the supplying reel and the gear so that constant friction is maintained between the rotating shaft and the inserting hole by virtue of the elastic force of the spring.

However, the structure of winding a correction tape in a correction tape adhesiver of the prior art has drawbacks that the correction tape is lengthened and subject to excessive tension in use of the correction tape, whereby it is inconvenient to use the correction tape adhesiver and it is frequent to be in trouble, because it is required to provide a plurality of grooves on the rotating shaft or to provide the compression spring in order to maintain appropriate friction between the inserting hole of the supplying reel and the rotating shaft of the gear, and because it is very difficult to manufacture the rotating shaft and the compression shaft.

SUMMARY OF THE INVENTION

Accordingly, it is an object of the present invention is to provide a structure of winding a correction tape in a correction tape adhesiver which eliminate the drawbacks involved in the prior art as described above, wherein a first auxiliary reel is arranged between a supplying reel and a winding reel such that a gear of the winding wheel is engaged rotatively with a gear of the first auxiliary reel, a second auxiliary reel is also arranged between the first auxiliary reel engaged with the winding reel and the supplying reel, the second auxiliary reel being rotated only by the frictional force of the correction tape, and the correction tape is fed from the supplying reel to the winding reel via the auxiliary reels, so that it is prevented that the correction tape is lengthened and subject to excessive tension even if the diameters of the rolled tape on the supplying reel and the winding reel are changed as the correction tape is used, whereby the trouble of the correction tape adhesiver is prevented, it is smooth to use the correction tape adhesiver, and it is easy to manufacture the correction tape adhesiver.

The foregoing object is accomplished in one embodiment by providing a structure of winding a correction tape in a correction tape adhesiver comprising a supplying reel and a winding reel arranged in upper and lower cases; and a tape guider projected through the front ends of the cases, through which a correction tape with a coating film applied thereon is fed from the supplying reel to winding reel, wherein said winding reel with a gear is arranged in the front part of the cases, and said supplying reel is arranged in the rear part of the cases, and wherein a first auxiliary reel with a gear is arranged between the supplying reel and the winding reel such that the gear of the winding wheel is engaged rotatively with the gear of the first auxiliary reel, and a second auxiliary reel is arranged between the supplying reel and the first auxiliary reel, said correction tape being fed from the supplying reel to the winding reel via the circumferential surfaces of the auxiliary reels.

BRIEF DESCRIPTION OF THE DRAWINGS

The preferred embodiment of the present invention will now be described by way of example with reference to the accompanying drawings in which.

DETAILED DESCRIPTION OF THE PREFERRED EMBODIMENT

Figure 1:
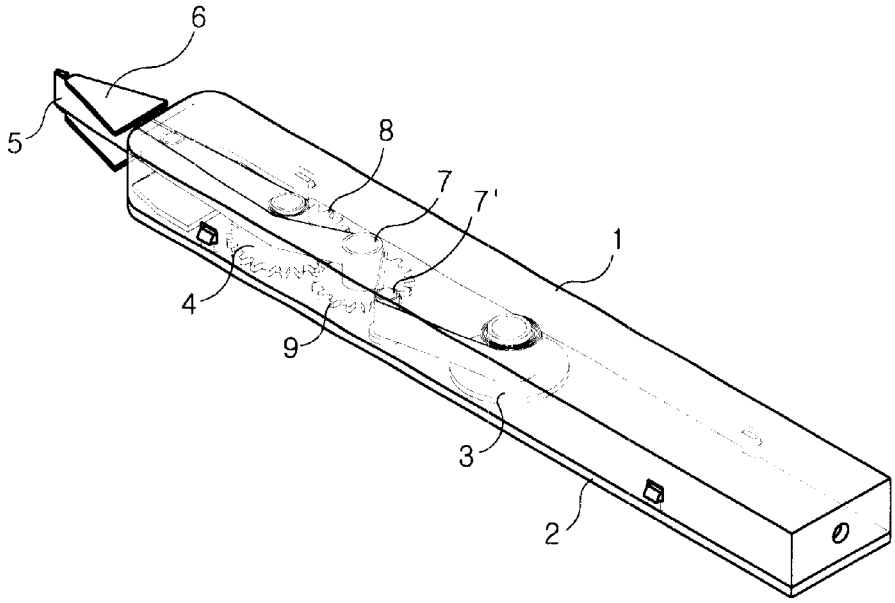
FIG. 1 is a perspective view of a correction tape adhesiver according to the present invention.
Figure 2:
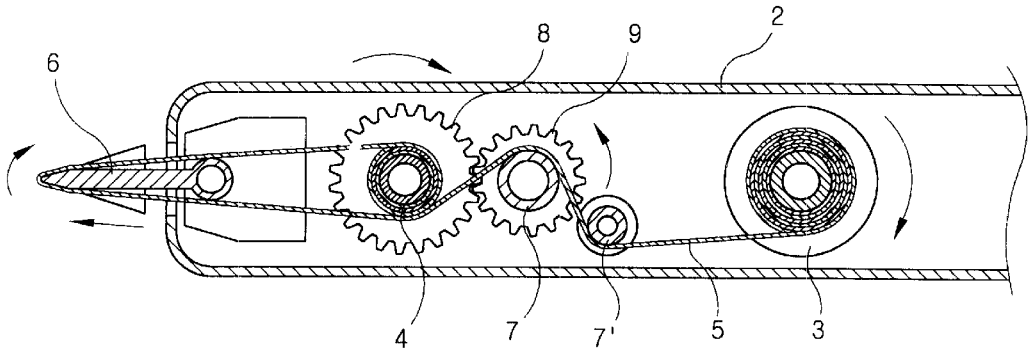
FIG. 2 is a font view in section of the correction tape adhesiver shown in FIG. 1.

As shown in FIGS. 1 and 2, a correction tape adhesiver according to the present invention comprises an upper case 1 and a lower case 2. On the lower case 2 are arranged a supplying reel 3 and a winding reel 4. To the lower part of the winding reel 4 is attached concentrically a gear 8. Between the supplying reel 3 and the winding reel 4 are arranged a first auxiliary reel 7 with a gear 9 attached concentrically to the lower part of the first auxiliary reel 7 such that the gear 8 of the winding wheel 4 is engaged rotatively with the gear 9 of the first auxiliary reel 7. Between the supplying reel 3 and the first auxiliary reel 7 is arranged a second auxiliary reel 7'. A guider 6 is projected through the front ends of the cases 1 and 2.

A correction tape 5 is rolled on the, supplying reel 3. The correction tape 5 includes a coating film applied thereon. The correction tape 5 is unrolled from the, reel 3, fed via circumferences of the auxiliary reel 7' and 7, is passed through the front ends of the cases 1 and 2 to the guider 6. Thereafter the correction tape 5 is passed through the guider 6, and then it is returned into the cases 1 and 2 and rolled onto the winding reel 4.

The operation of the correction tape adhesiver constructed as mentioned above will now be described.

In order to use the correction tape adhesiver according to the present invention, it is necessary that the guider 6, through which the correction tape 5 is passed, is pressed against the position in which clerical error has been occurred and then moved, as ever in the prior art. By virtue of the tension thereof, the correction tape 5 supplied from the supplying reel 3 can be fed to the winding reel 4 via the guider 6. As a result, the white coating film applied on the surface of the correction tape 5 is transferred on the position in which clerical error has been occurred, so that the position in which clerical error has been occurred can be screened, whereby the correction of the position in which clerical error has been occurred is possible.

According to the present invention, the correction tape 5 supplied from the supplying reel 3 is fed to the winding reel 4 via the circumferential surface of the second auxiliary reel 7' and then via the circumferential surface of the first auxiliary reel 7 having the gear 9 engaged rotatively with the gear 8 of the winding reel 4. As a result, the frictional force generated between the correction tape 5 and the auxiliary reels 7 and 7' is maintained constantly, when the correction tape 5 is passed through the auxiliary reels 7' and 7. Consequently, it is smooth and convenient to use the correction tape adhesiver, and it is prevented that the correction tape 5 is lengthened and subject to excessive tension. Furthermore, it is easy to manufacture the correction tape adhesiver because high accuracy is not required when the correction tape adhesiver is manufactured.

As mentioned above, the structure of winding a correction tape in the correction tape adhesiver according to the present invention includes the auxiliary reels arranged between the winding reel and the supplying reel, through which the correction tape is fed from the supplying reel to the winding reel, unlike the conventional system in which the winding reel is engaged directly with the supplying reel. As a result, it is smooth to use the correction tape adhesiver, the trouble of the correction tape adhesiver is prevented, and it is easy to manufacture the correction tape adhesiver.

According to the present invention, an auxiliary reel is arranged between a supplying reel and a winding reel such that a gear of the winding wheel is engaged rotatively with a gear of the auxiliary reel, another auxiliary reel is also arranged between the auxiliary reel engaged with the winding reel and the supplying reel, the auxiliary reel being rotated only by the frictional force of the correction tape, and the correction tape is fed from the supplying reel to the winding reel via the auxiliary reels, so that it is prevented that the correction tape is lengthened and subject to excessive tension even if the diameters of the rolled tape on the supplying reel and the winding reel are changed as the correction tape is used, whereby the trouble of the correction tape adhesiver is prevented, it is smooth to use the correction tape adhesiver, and it is easy to manufacture the correction tape adhesiver.

What is claimed is:

1. A structure of winding a correction tape in a correction tape dispenser comprising a supplying reel (3) and a winding reel (4) arranged in upper and lower cases (1) (2); and a tape guider (6) projected through front ends of the cases, through which a correction tape (5) with a coating film applied thereon is fed from the supplying reel (3) to winding reel (4), wherein said winding reel (4) with a gear (8) is arranged in the front ends of the cases, and said supplying reel (3) is arranged in rear ends of the cases, and wherein a first auxiliary reel (7) with a gear (9) is arranged between the supplying reel (3) and the winding reel (4) such that the gear (8) of the winding wheel (4) is engaged rotatively with the gear (9) of the first auxiliary reel (7), and a second auxiliary reel (7') is arranged between the supplying reel (3) and the first auxiliary reel (7), said correction tape (5) being fed from the supplying reel (3) to the winding reel (4) via circumferential surfaces of the auxiliary reels (7') (7).

* * * * *